US010326234B2

(12) United States Patent
An

(10) Patent No.: US 10,326,234 B2
(45) Date of Patent: Jun. 18, 2019

(54) CABLE PROTECTION KIT AND RADIO REMOTE UNIT INCLUDING THE SAME

(71) Applicant: Telefonaktiebolaget LM Ericsson (publ), Stockholm (SE)

(72) Inventor: Jianjun An, Beijing (CN)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 15/777,145

(22) PCT Filed: Dec. 8, 2015

(86) PCT No.: PCT/CN2015/096643
§ 371 (c)(1),
(2) Date: May 17, 2018

(87) PCT Pub. No.: WO2017/096523
PCT Pub. Date: Jun. 15, 2017

(65) Prior Publication Data

US 2018/0331461 A1 Nov. 15, 2018

(51) Int. Cl.
*H01R 13/52* (2006.01)
*H01R 13/629* (2006.01)

(52) U.S. Cl.
CPC ... *H01R 13/5219* (2013.01); *H01R 13/62938* (2013.01)

(58) Field of Classification Search
CPC ..... H01R 13/5219
See application file for complete search history.

(56) References Cited

U.S. PATENT DOCUMENTS 3,904,812 A 9/1975 Daffron ..... H05K 5/0039 174/549
4,822,293 A 4/1989 Robson ..... H01R 13/5202 439/271

(Continued)

FOREIGN PATENT DOCUMENTS

CN 201233463 Y 5/2009
CN 103163597 A 6/2013

(Continued)

OTHER PUBLICATIONS

International Search Report and Written Opinion for International Patent Application No. PCT/CN2015/096643, dated Aug. 24, 2016, 13 pages.

*Primary Examiner* — Tho D Ta
(74) *Attorney, Agent, or Firm* — Winthrow & Terranova, PLLC

(57) ABSTRACT

The present disclosure provides a cable protection kit and a Radio Remote Unit including the same. The cable protection kit (100,100') for RRU(200) includes a main body(10,10'), a sealing member(30,30') and a pressing assembly(20,20'). The main body(10,10') has at least one hole(50) for correspondingly accommodating at least one cable(40), wherein the at least one hole(50) extends from a first end(11) of the main body(10,10') to an opposite second end(12) thereof along a longitudinal direction of the main body(10,10'). The sealing member(30,30') is located onto the first end(11) and at least partly enclosing the first end(11). The pressing assembly(20,20') is located onto the main body(10,10') adjacent to the sealing member(30,30') and configured to press and deform the sealing member(30,30') so that the sealing member(30,30') fixes and seals up the cable protection kit(100,100') to a frame of the RRU(200).

15 Claims, 7 Drawing Sheets

(56) References Cited

U.S. PATENT DOCUMENTS

| | | | | |
|---|---|---|---|---|
| 5,222,909 | A | 6/1993 | Nomura et al. | |
| 6,464,522 | B2 | 10/2002 | Osawa | H01R 13/5202 439/135 |
| 7,097,500 | B2 | 8/2006 | Montena | H01R 9/05 439/587 |

FOREIGN PATENT DOCUMENTS

| | | | |
|---|---|---|---|
| CN | 103904477 | A | 7/2014 |
| CN | 204809548 | U | 11/2015 |
| DE | 20204187 | U1 | 8/2002 |
| GB | 2149589 | A | 6/1985 |

CABLE PROTECTION KIT AND RADIO REMOTE UNIT INCLUDING THE SAME

This application is a 35 U.S.C. § 371 national phase filing of International Application No. PCT/CN2015/096643, filed Dec. 8, 2015, the disclosure of which is incorporated herein by reference in its entirety.

TECHNICAL FIELD

The present disclosure generally relates to communication systems, and more particularly to a cable protection kit and an radio remote unit (abbreviated as RRU).

BACKGROUND

RRUs are often used in outdoor, and thus IP55/65 should be fulfilled. There are many external interfaces, and these interfaces also need to be designed to fulfill the IP55/65 or more stricter requirements. For current products, there are two solutions available in the market. With referring to FIG. 1*a*, one solution is an outdoor connector 300. As shown in FIG. 1*b*, the other solution is an interface chamber 400.

It is well known in the art that the solution using the outdoor connector 300 is very expensive, though it can reduce the size of the obtained product. The outdoor connector 300 also needs a big area of a front panel, because an operation space should be kept between connectors. The operation space also should be kept for IP protection between the connector and a frame of the product.

With respect to the other solution, using the interface chamber 400 is cheap, because standard indoor connectors are used and IP protection is designed in the frame of the product and cable sealing is combined with a gasket. However, more space should be kept for cable routing, and thus it would lead to bigger size of the product. Further, this solution has another drawback that it will lead to water leakage in site due to being unreliable.

SUMMARY

In view of the foregoing, an object of the present disclosure is to overcome or at least mitigate above shortcomings of the prior art solution for finding an alternative solution to replace the outdoor connector and provide a low cost solution.

Further, another object of the present disclosure is to provide a cable protection kit and the RRU including it, wherein the innovative thinking is to use the standard indoor connectors by a simple connector protection solution.

In accordance with one aspect of the present invention, it provides a cable protection kit for RRU, comprising:

a main body having at least one hole for correspondingly accommodating at least one cable, wherein the at least one hole extends from a first end of the main body to an opposite second end thereof along a longitudinal direction of the main body;

a sealing member located onto the first end and at least partly enclosing the first end; and a pressing assembly, located onto the main body adjacent to the sealing member and configured to press and deform the sealing member so that the sealing member fixes and seals up the cable protection kit to a frame of the RRU.

In accordance with another aspect of the present invention, it provides a Radio Remote Unit (RRU) including the cable protection kit as described above.

BRIEF DESCRIPTION OF THE DRAWINGS

These aspects and/or other aspects as well as advantages of the present invention will become obvious and readily understood from the description of the preferred embodiments of the present invention in conjunction with the accompanying drawings below, in which.

DETAILED DESCRIPTION OF EMBODIMENTS

In the discussion that follows, specific details of particular embodiments of the present techniques are set forth for purposes of explanation and not limitation. It will be appreciated by those skilled in the art that other embodiments may be employed apart from these specific details.

Furthermore, in some instances detailed descriptions of well-known methods, structures, and devices are omitted so as not to obscure the description with unnecessary detail.

Figure 2:
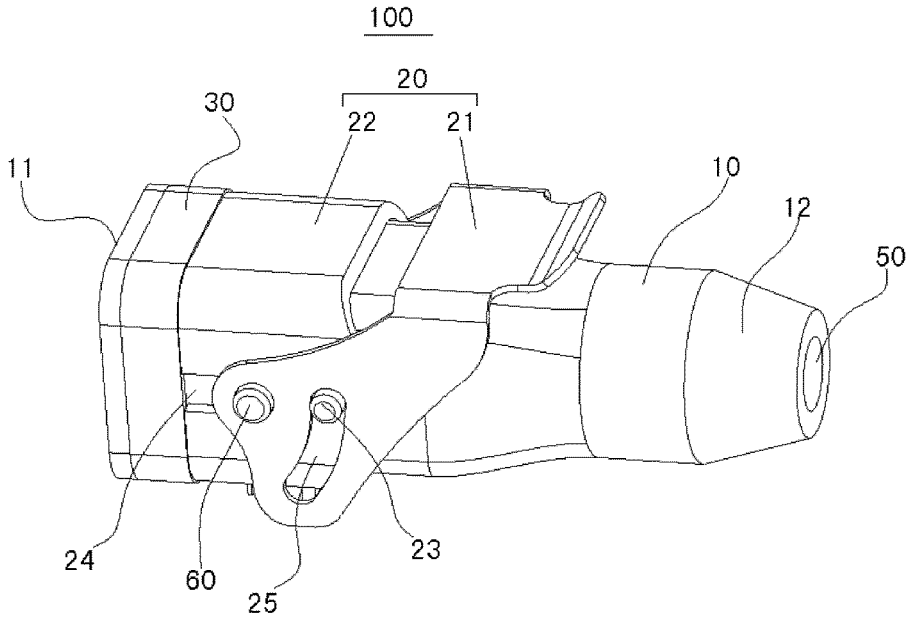
FIG. 2 is a schematic perspective view for showing a structure of a cable protection kit for RRU in accordance with one embodiment of the present invention without being inserted with a cable.
Figure 9:
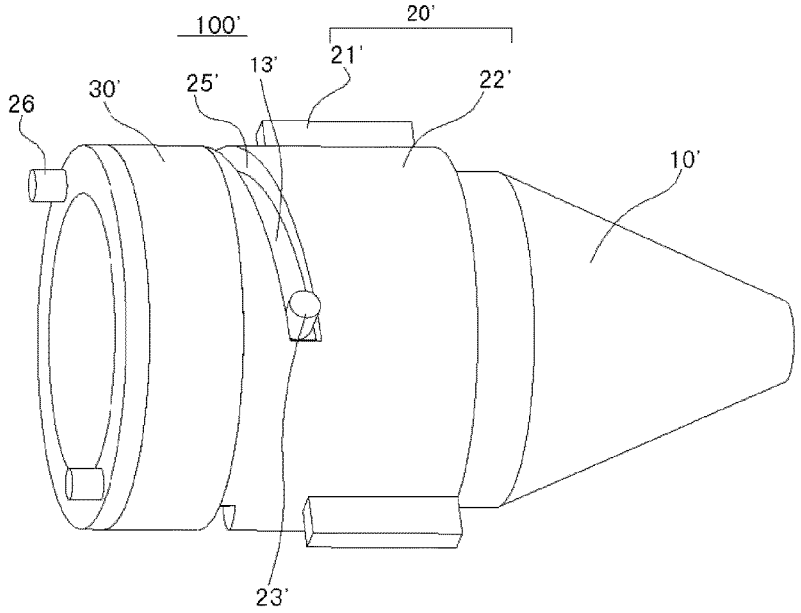
FIG. 9 is a schematic view for showing a variant of the cable protection kit in accordance with another embodiment of the present invention without being inserted with a cable.

As can be seen from FIGS. 2 and 9, the present invention provides two alternative cable protection kits 100 and 100', due to the different shape thereof. Firstly, the structures in FIG. 2 are described in more detail.

Figure 3:
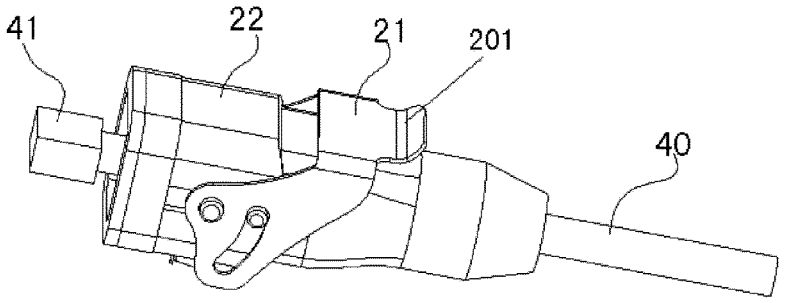
FIG. 3 is a schematic view for showing the cable protection kit as shown in FIG. 2 accommodating a cable therein.
Figure 4:
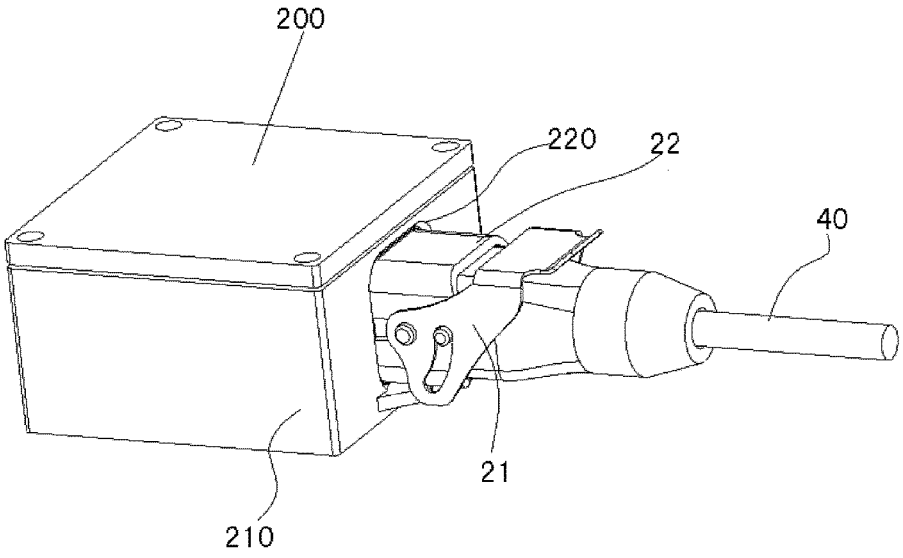
FIG. 4 is a schematic view for showing an integrated structure of the cable protection kit as shown in FIG. 3 and a frame of RRU.

With referring to FIGS. 2 and 3, it shows a cable protection kit 100 for RRU 200 (abbreviation of Radio Remote Unit, shown in FIG. 4). Specifically, the cable protection kit 100 includes a main body 10, a sealing member 30, and a pressing assembly 20 cooperated with each other. The sealing member 30 and the pressing assembly 20 both are provided onto the main body 10.

As shown, the main body 10 has a hole 50 which is configured to accommodate a cable 40. The hole 50 extends from a first end 11 of the main body 10 to an opposite second end 12 thereof along a longitudinal direction of the main body 10 (i.e., the direction from left to right of the drawing page). It should be understood that more holes can be provided within the main body 10, and the number thereof can be selected as required actually. Alternatively, more parallel holes can be provided onto the main body in the present invention, though the figure only shows one hole as an example. Alternatively, each hole can house one cable or more cable, if necessary. It is apparent that the present invention is not limited to this.

The sealing member 30 is used herein for fixation and sealing up. In one example, the sealing member 30 is provided in a form of a gasket, but the present invention is not limited to this. The sealing member 30 can be embodied in any form, as long as it can function for fixation and sealing up. For sake of briefness and conciseness, the sealing member 30 is called as the gasket below.

The gasket 30 is located on the first end 11 and encloses the first end 11 around the periphery of the main body 10. As described later, the gasket 30 is use to fix and seal up the cable protection kit 100 to a frame 210 of Radio Remote Unit 200. As shown, the gasket 30 entirely surrounds the first end 11. Of course, the gasket 30 also can be designed to partially surround the first end 11. That is, the form of the gasket 30 is not limited herein, as long as it can achieve the function as described above. In addition, the gasket 30 is made of an elastomeric material or similar material, for example a silicon rubber.

In FIG. 2, the first end 11 of the main body 10 is designed in a quadrate shape, and thus the gasket 30 is formed in a quadrate shape. Further, the main body 10 is made of metal or plastic. It could be an assembled part or a single part. All the other parts are assembled into the main body 10 and the cable 40 is fixed by the main body 10.

Further, the pressing assembly 20 is located onto the main body 10 adjacent to the gasket 30 and configured to press and deform the gasket 30, so that the gasket 30 fixes and seals up the cable protection kit 100 to the frame 210.

Figure 5:
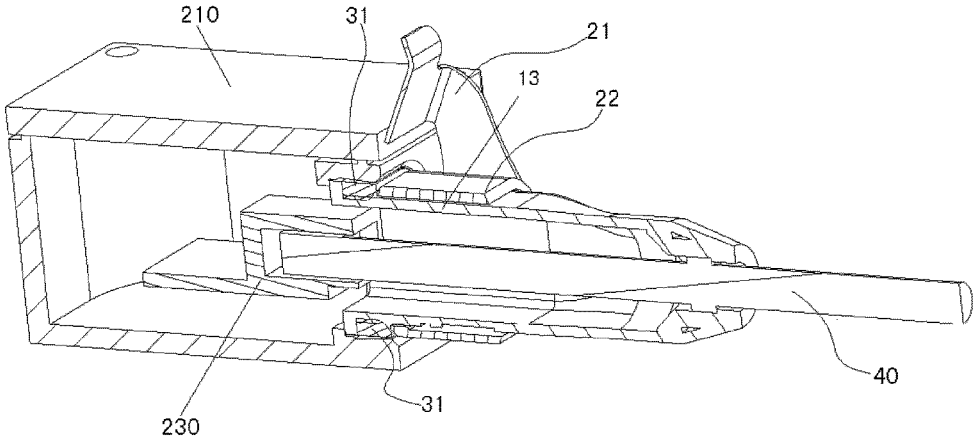
FIG. 5 is a cross sectional view of the integrated structure as shown in FIG. 4.

In combination with FIG. 4, in order to fix with the cable protection kit 100, the frame 210 at one side thereof (for example, the right side of the figure) is provided with an opening 220. The first end 11 of the cable protection kit 100 is inserted into the opening 220, and after then the cable protection kit 100 and the frame 210 are fixed and assembled together by means of pushing and pressing the gasket 30 through the pressing assembly 20. In the assembled state as shown, the cable 40 at one end is connected to a board 230 (shown in FIG. 5) within the frame 210, and the other end extends out of the cable protection kit 100. In order to securely fix with the board 230, the end of the cable 40 is designed with a protruding part 41, as shown in FIG. 3.

The pressing assembly 20 includes a slide 22 and a holder 21 cooperated with each other. The slide 22 is capable of moving forward and backward onto the main body 10 by the holder 21 and the holder 21 is configured to provide a force for moving the slide 22 so that the gasket 30 is pressed and deformed by the slide 22. In this example, each of the slide 22 and a first part 13 of the main body 10 where the slide 22 is located is in a quadrate shape. This example is only intended to explain the working principle of the cable protection kit 100, and of course they can be changed into other shapes as long as they can function in the same way as described in the present invention. In addition, the slide 22 is made of plastic or metal and it can be moved by the holder 21. The holder 21 is made of plastic or metal, and used to provide the force for moving the slide 21.

At each of two opposite sides of the first part 13, a pivot shaft 60 is provided. The pivot shaft 60 is connected with a fixing hole of the holder 21 by passing though a traverse groove 24 on the slide 22. Further, a pin 23 for stopping and/or limiting the movement of the slide 22 is provided at each of two opposite sides of the slide 22 and housed within a slide groove 25 of the holder 21. Please be noted that since the slide 22 is needed to move forward and backward along the longitudinal direction of the main body 10, it is necessary for three of them to align substantially with each other. In one preferable illustrative example, the traverse groove 24, the pivot shaft 60 and the pin 23 are substantially located at the same height level at the same side of the cable protection kit 100. In one example, the slide groove 25 is in a shape of arc or curve, and intersects with the longitudinal direction.

As shown in FIG. 2, it shows the slide 22 in an unlocking position, that is, the upper end of the slide groove 25 is adjacent to the pin 23 or contacts the pin 23. As the holder 21 is lifted up along with the pin 23 slides within the slide groove 25, the slide 22 is pushed to move forward facing to the frame 210, and then slide 22 will press the gasket 30 to be deformed. Finally, the frame 210 and the cable protection kit 100 are fixed together. At this time, the slide 22 is located in a locking position. When the holder 21 is lifted or lowered down, the slide 22 will move backward toward the second end 12 of the main body 10 until the lower end of the slide groove 25 comes in contact with the pin 23, and finally the slide 22 changes from the locking position to the unlocking position.

It should be understood that since the gasket 30 is positioned at the left side of the slide 22, and the holder 21 is positioned at the right side of the slide 22 opposite to the gasket 30, if a handle part 201 of the holder 21 is positioned above the main body 10 as shown in FIGS. 2 and 3, the lifting up of the holder 21 causes the slide 22 to move forward and become into the locking position from the unlocking position; and if the handle part 201 of the holder 21 is positioned below the main body 10 (opposite to the shown in FIGS. 2 and 3 with respect to the longitudinal direction), the lifting down of the holder 21 causes the slide 22 to move forward and become into the locking position from the unlocking position. In other words, the specific operational direction of the holder 21 is not limited herein, as long as the holder 21 can push and move the slide 22.

Figure 6A:
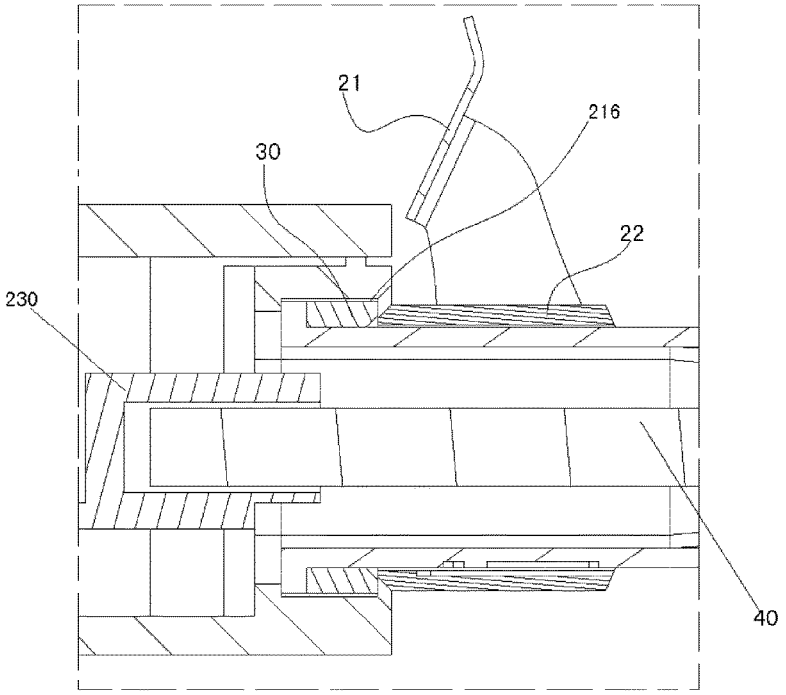
FIG. 6*a* is a partial cross sectional view for showing a non-deformed gasket in FIG. 5 before pressing and pushing a slide of the cable protection kit.
Figure 6B:
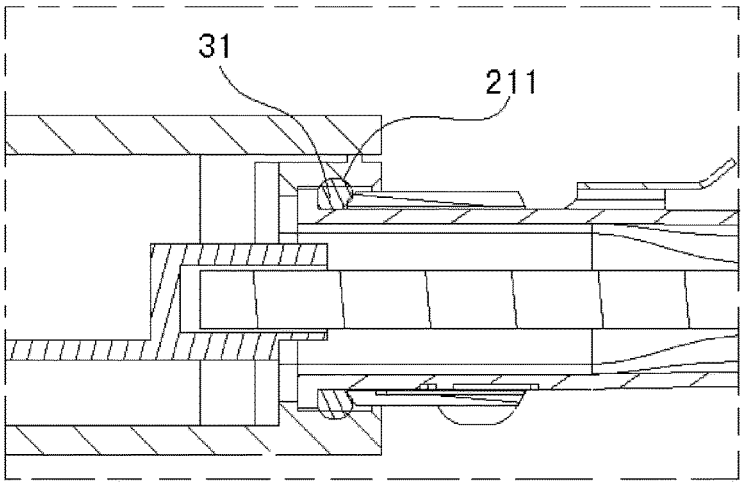
FIG. 6*b* is another partial cross sectional view for showing a deformed gasket in FIG. 5 after pressing and pushing a slide of the cable protection kit.
Figure 6C:
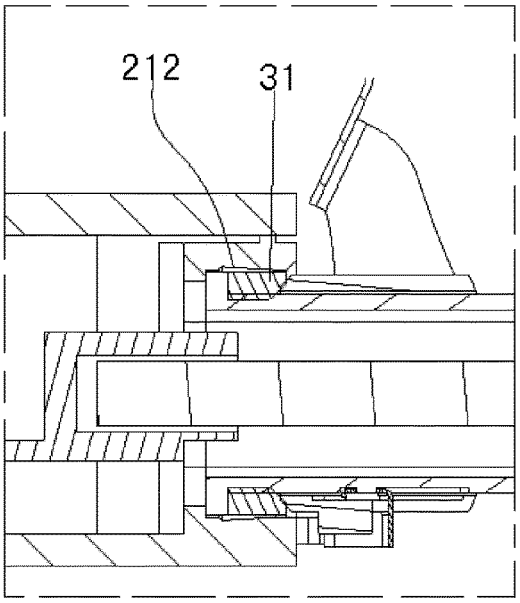
FIG. 6*c* is a yet another partial cross sectional view for showing the frame having a subuliform hole for housing the deformed gasket as shown in FIG. 6*b;*

As shown in FIGS. 5, 6*a*, 6*b* and 6*c*, the frame 210 is disposed with a slot 211, 212, 216. As discussed above, in the locking position, the slide 22 is pressing the gasket 30 and thus the deformed part 31 of the gasket 30 will be present. The slot 211, 212, 216 can be rectangular, square, elliptical or subuliform so as to house the deformed part 31 of the gasket 30 and provide a bigger fixing force. Taking into this, the elliptical slot 211 as shown in FIG. 6*b* and the subuliform slot 212 as shown in FIG. 6*c* can provide a bigger fixing force than the rectangular slot 216 as shown in FIG. 6*a*.

Please be noted that in the locking position, at least a part of the cable protection kit 100 is fixed with the frame 210, specifically, the gasket 30 is partly or entirely housed within the slot of the frame 210, so as to achieve the fixation and the sealing up.

Except that the bigger fixing force can be obtained by the design of the slot 211, 212, there are other means available, for example other fixing parts, like screw or clip. Please see FIGS. 7*a* and 7*b*, and the frame 210 has at least two protruding parts 213 adjacent to a bottom edge of the opening 220, which are used to fix with the pressing assembly 20 (for example the slide 22) by means of the clip 214, when the slide 22 is in the locking position. In this example, the two protruding parts 213 are opposite to each other and the clip 214 is inserted therebetween.

Alternatively, in the locking position, at least one protruding part 213 of the frame 210 is fixed with the pressing assembly 20 by means of a screw(not shown).

Figure 8:
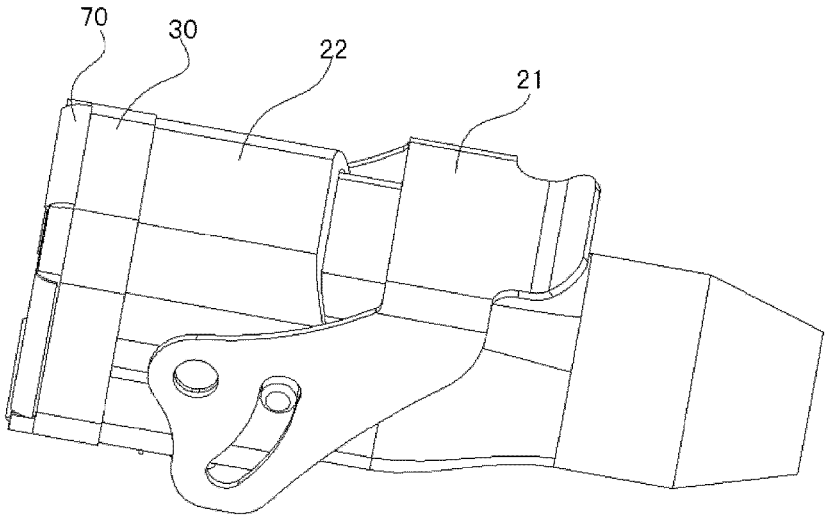
FIG. 8 is a schematic view for showing an EMC clip which is provided on the cable protection kit.

With referring to FIG. 8, in accordance to specific requirement on electromagnetic shielding or EMC, an EMC clip 70 can be provided onto the first end 11 of the main body 10 in front of the gasket 30. The shape of the EMC clip 70 matches with that of the main body 10, and it can be designed to entirely or partly enclose the first end 11.

With referring to FIG. 9, it provides an alternative cable protection kit 100' for RRU in accordance with another embodiment of the present invention. Because the main body 10' in this embodiment is designed into a columniform shape rather than the described quadrate shape, the pressing assembly 20' also employs a different working way from that shown in FIG. 2. Specifically, the present embodiment utilizes the screw-feeding, whereas the embodiment shown in FIG. 2 uses a slide movement. Except from the above differences, the remaining are substantially identical with the previous embodiment, and thus they are not repeatedly discussed herein. The same component is marked by the similar reference number with a symbol "'" for distinguishing.

Figure 7A:
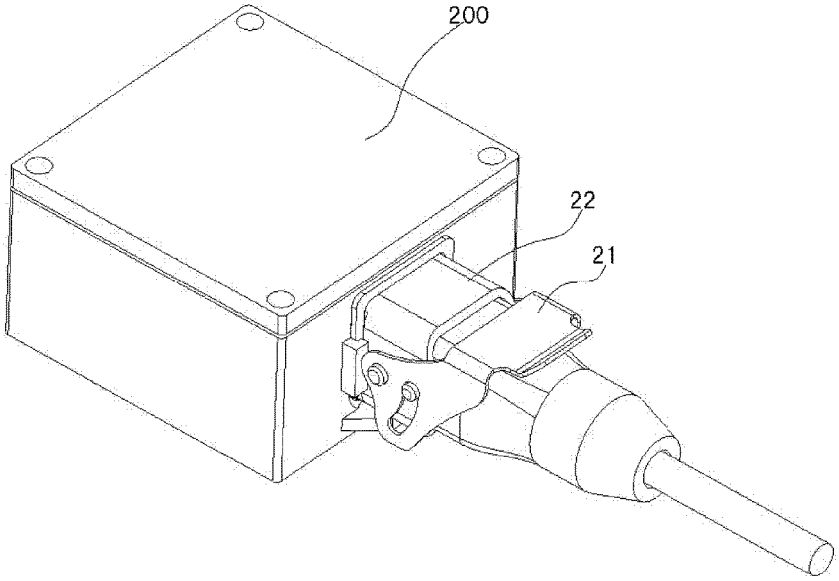
FIGS. 7*a* and 7*b* are schematic views for showing the connection of the cable protection kit with the frame of RRU by a clip, respectively.
Figure 7B:
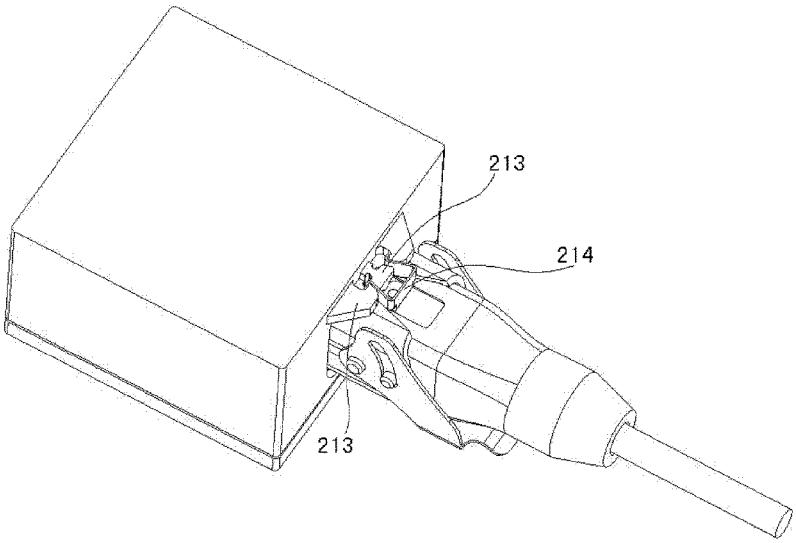

In this example, the pressing assembly 20' includes a pressing ring 22' and at least one holding part 21'. The holding part 21' is located on the pressing ring 22' and used to hold the pressing ring 22', and thus it can be appreciated that the number thereof is not limited to the shown in the figure, and can be set as actually required. If a plurality of holding parts 21' are used, they would be spaced apart on the surface of the pressing ring 22'. The pressing ring 22' has an internal thread on its inner surface. A first part 13' of the main body 10' where the pressing ring 22' is located has an external thread on its outer surface. That is, the pressing ring 22' and the main body 10' are fitted or installed with thread connection. In this way, the pressing ring 22' can be screwed up from the second end 12 toward the first end 11 so as to press and deform the sealing member 30'. After the screwing up, as described above, the sealing member 30' for example a gasket has at least one part fixed into the slot of the opening 220. In other words, the cable protection kit 100' will be in the locking position, at this time. Of course, after the unscrewing process, the cable protection kit 100' will be in the unlocking position. Alternatively, the clip or screw, the protruding part as shown in FIGS. 7*a* and 7*b* can also be applicable into the structure of FIG. 9. Further, the slots as shown in FIGS. 5, 6*a*-6*c* can also be applicable into the structure of FIG. 9. The EMC clip as shown in FIG. 9 is also applicable into the structure of FIG. 9. Since these are discussed in more detail above, it is apparent for the skilled person to apply them into the structure of FIG. 9 and they are not repeated herein.

Specifically, the pressing ring 22' is provided with a slide groove 25' and the first part 13' of the main body 10' is provided with a pin 23' cooperating with the slide groove 25' so as to stop and limit the movement of the pressing ring 22' during the process of screwing or unscrewing. In one illustrative example, the slide groove 25' is curved or spiral so as to match the screw or unscrew feed of the pressing ring 22'. Of course, the shape of the slide groove 25' is not limited herein, and the skilled person can select any suitable shape as actually required.

In this example, an end surface of the first end 11 of the main body 10' is provided with at least one fixing pin 26 for fixing with the frame 210. It can be seen that when in the locking position, the fixing pin 26 can provide a bigger fixing force for the cable protection kit 100'.

In addition, other embodiment of the present invention also provides a Radio Remote Unit (RRU), which uses or includes the cable protection kit as described above. Since the RRU is not improved in the present invention, its key point lies in the use of the described cable protection kit. Therefore, they are not discussed repeatedly herein.

Figure 1A:
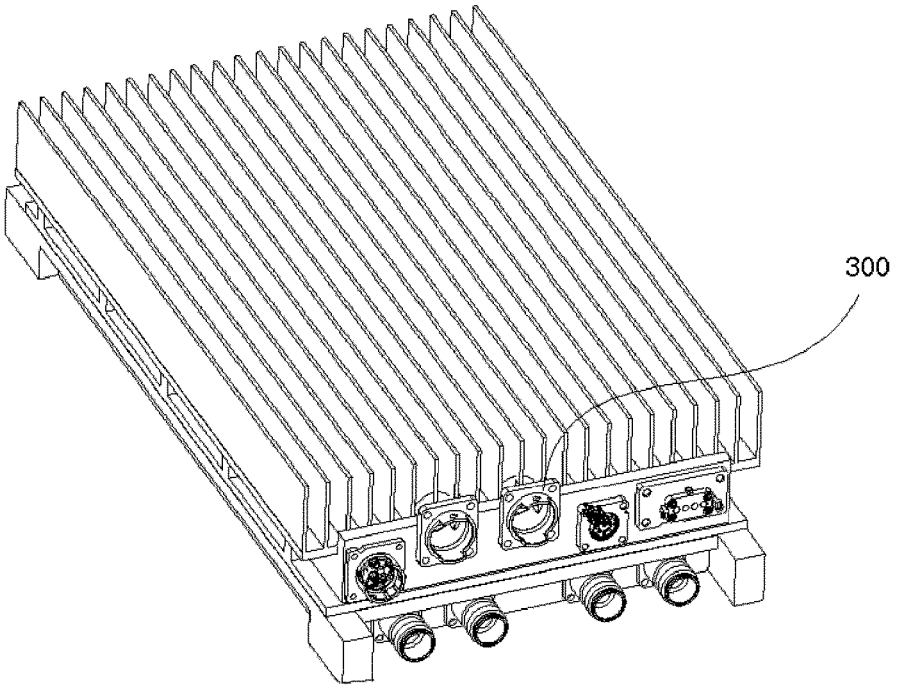
FIGS. 1*a* and 1*b* are respectively schematic views for showing structures of an outdoor connector and an interface chamber in the prior art.
Figure 1B:
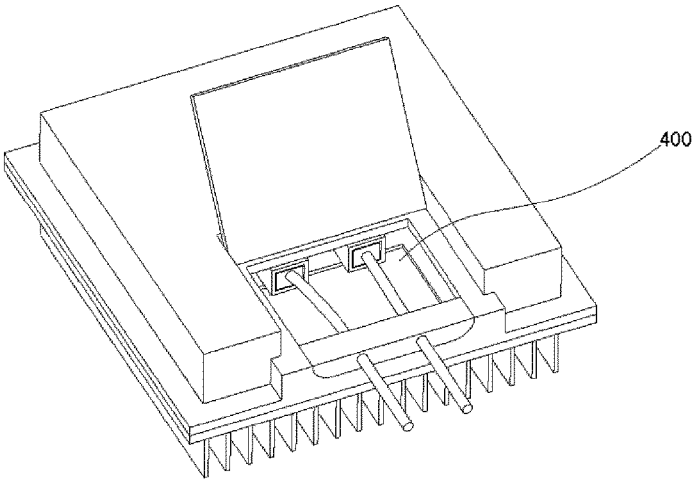
Figure 10:
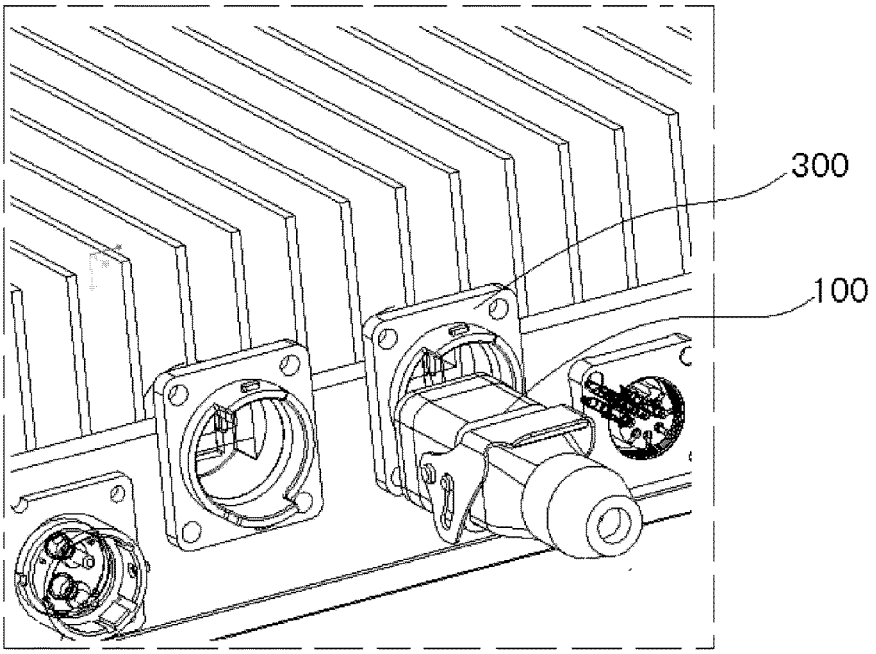
FIG. 10 shows a comparison view of the present cable protection kit with the outdoor connector as shown in FIG. 1*a.*

FIG. 10 shows a comparison view of the present cable protection kit with the outdoor connector as shown in FIG. 1*a*. As compared with the currently used CPRI ODC as shown in FIG. 1*a* (called as the current solution herein), the cable protection kit 100, 100' can be fixed to the frame 210 directly, and the cable protection kit 100 of the present solution has an area which is only 36% of the corresponding outdoor connector 300 of the current solution. The present solution can be any suitable shape, for example being quadrate or columniform, and thus provide the feasibility that two connectors provided by the current solution are combined to one connector.

In addition, the present invention provides a cable protection kit, rather than a connector. The above described indoor connectors can be used as the outdoor connectors by means of the present cable protection kit. Due to the current outdoor connector being very expensive, the present cable protection kit can significantly reduce the cost thereof. Further, the production line for the outdoor connector can be saved also. In the current solution, the connector should be fixed with the frame by 4 screws, and the present solution does not need any screw.

Moreover, for the present solution, the cable protection kit is very easy to assembly in site, because any tool and screws do not need.

The present disclosure is described above with reference to the embodiments thereof. However, those embodiments are provided just for illustrative purpose, rather than limiting the present disclosure. The scope of the disclosure is defined by the attached claims as well as equivalents thereof. Those skilled in the art can make various alternations and modifications without departing from the scope of the disclosure, which all fall into the scope of the disclosure.

What is claimed is:

1. A cable protection kit for a Radio Remote Unit (RRU), comprising:

a main body having at least one hole for correspondingly accommodating at least one cable, wherein the at least one hole extends from a first end of the main body to an opposite second end thereof along a longitudinal direction of the main body;

a sealing member located onto the first end and at least partly enclosing the first end; and a pressing assembly, located onto the main body adjacent to the sealing member and configured to press and deform the sealing member so that the sealing member fixes and seals up the cable protection kit to a frame of the RRU;

wherein:

the pressing assembly comprises a pressing ring and at least one holding part located on the pressing ring and for holding the pressing ring;

the pressing ring has an internal thread on its inner surface;

a first part of the main body where the pressing ring is located has an external thread on its outer surface;

the pressing ring and the main body are fitted with thread connection, and the pressing ring is screwed up from the second end toward the first end so as to press and deform the sealing member; and the pressing ring is provided with a slide groove and the first part of the main body is provided with a pin cooperating with the slide groove so as to stop and limit the movement of the pressing ring during a process of screwing or unscrewing.

2. The cable protection kit for RRU according to claim 1, wherein the frame of the RRU at one side thereof has an opening, and the first end of the cable protection kit is inserted into the opening and then the cable protection kit and the frame are fixed and assembled together by means of pushing and pressing the sealing member through the pressing assembly.

3. The cable protection kit for RRU according to claim 1, wherein when the cable protection kit and the frame of RRU are assembled together, the cable is connected to a board within the frame.

4. The cable protection kit for RRU according to claim 1, wherein the sealing member is in a form of a gasket, which entirely encloses the first end, the main body is only provided with one hole for housing the only one cable, or the main body is provided with a plurality of the parallel hole, each of which is used for housing one cable.

5. The cable protection kit for RRU according to claim 1, wherein the frame has a slot which is rectangular, square, elliptical or subuliform so as to house a deformed part of the sealing member and provide a bigger fixing force.

6. The cable protection kit for RRU according to claim 1, wherein an electromagnetic compatibility (EMC) clip is provided onto the first end of the main body in front of the sealing member.

7. The cable protection kit for RRU according to claim 1, wherein in a locking position, at least a part of the cable protection kit is fixed with the frame.

8. The cable protection kit for RRU according to claim 7, wherein in the locking position, at least two protruding parts of the frame adjacent to a bottom edge of the opening are fixed with the pressing assembly by means of a clip; or in the locking position, at least one protruding part of the frame is fixed with the pressing assembly by means of a screw.

9. The cable protection kit for RRU according to claim 1, wherein the sealing member is made of an elastomeric material.

10. The cable protection kit for RRU according to claim 9, wherein each of the pressing assembly and the main body is made of plastic or metal.

11. The cable protection kit for RRU according to claim 9, wherein the sealing member is made of a silicon rubber.

12. A cable protection kit for RRU, comprising:

a main body having at least one hole for correspondingly accommodating at least one cable, wherein the at least one hole extends from a first end of the main body to an opposite second end thereof along a longitudinal direction of the main body;

a sealing member located onto the first end and at least partly enclosing the first end; and a pressing assembly, located onto the main body adjacent to the sealing member and configured to press and deform the sealing member so that the sealing member fixes and seals up the cable protection kit to a frame of the RRU;

wherein:

the pressing assembly comprises a pressing ring and at least one holding part located on the pressing ring and for holding the pressing ring;

the pressing ring has an internal thread on its inner surface;

a first part of the main body where the pressing ring is located has an external thread on its outer surface;

the pressing ring and the main body are fitted with thread connection, and the pressing ring is screwed up from the second end toward the first end so as to press and deform the sealing member; and an end surface of the first end of the main body is provided with at least one fixing pin for fixing with the frame and/or the first part of the main body is in a columniform shape.

13. A cable protection kit for RRU, comprising:

a main body having at least one hole for correspondingly accommodating at least one cable, wherein the at least one hole extends from a first end of the main body to an opposite second end thereof along a longitudinal direction of the main body;

a sealing member located onto the first end and at least partly enclosing the first end; and a pressing assembly, located onto the main body adjacent to the sealing member and configured to press and deform the sealing member so that the sealing member fixes and seals up the cable protection kit to a frame of the RRU;

wherein:

the pressing assembly comprises a slide and a holder cooperated with each other, wherein the slide is capable of moving forward and backward onto the main body by the holder, which is configured to provide a force for moving the slide so that the sealing member is pressed and deformed by the slide;

each of the slide and a first part of the main body where the slide is located is in a quadrate shape;

a pivot shaft is provided at each of two opposite sides of the first part, and is connected with a fixing hole of the holder by passing through a traverse groove on the slide; and a pin for limiting and stopping the movement of the slide is provided at each of two opposite sides of the slide, and housed within an arced or curved slide groove of the holder.

14. The cable protection kit for RRU according to claim 13, wherein the sealing member is located at one side of the slide while the holder is located at an opposite side of the slide to the sealing member;

when moving to a locking position, if a handle part of the holder is positioned above the main body the holder is lifted up; and if a handle part of the holder is positioned below the main body the holder is lowered down, so that the slide is pushed to move forward facing to the frame, and then the slide will press the sealing member to be deformed so that the frame and the cable protection kit are fixed together.

15. The cable protection kit for RRU according to claim 13, wherein at the same side of the cable protection kit, the traverse groove, the pivot shaft and the pin are substantially aligned with each other.

* * * * *